United States Patent [19]

Wilson

[11] Patent Number: 4,634,077

[45] Date of Patent: Jan. 6, 1987

[54] YARN CADDY

[76] Inventor: Christine A. Wilson, 31 N. Laurel St., Ventura, Calif. 93001

[21] Appl. No.: 711,925

[22] Filed: Mar. 15, 1985

Related U.S. Application Data

[63] Continuation-in-part of Ser. No. 422,393, Sep. 24, 1982, abandoned.

[51] Int. Cl.[4] ..... B65H 49/32

[52] U.S. Cl. ..... 242/139; 242/130; 242/130.1; 242/134; 242/141

[58] Field of Search ..... 242/139, 140, 141, 146, 242/134, 130, 130.1, 130.3, 130.4, 127, 128, 129.5, 129.7, 71.9, 118.5, 68; 223/106, 107, 108, 109 R, 120; D3/20, 18, 23, 24, 25, 26

[56] References Cited

U.S. PATENT DOCUMENTS

| | | | |
|---|---|---|---|
| D. 46,137 | 7/1914 | Reist | D3/26 |
| 1,395,155 | 10/1921 | Smith | 242/139 |
| 1,557,424 | 10/1925 | Conant | 242/71.9 |
| 2,090,554 | 8/1937 | Rubinstein | 242/134 X |
| 2,226,024 | 12/1940 | Smith | 242/130 |
| 2,410,018 | 10/1946 | D'Arcy | 242/141 |
| 2,491,585 | 12/1949 | Sammons | 242/141 |
| 3,377,035 | 4/1968 | Sparr | 242/139 |
| 3,420,468 | 1/1969 | Rhoades | 242/134 |
| 3,591,105 | 7/1971 | Perlino | 242/129.7 |
| 3,637,150 | 1/1972 | Butz | 242/54 R |
| 3,762,615 | 10/1973 | McCallister | 223/106 |
| 4,112,711 | 9/1978 | Tripp | 66/1 A |
| 4,330,095 | 5/1982 | Carter | 242/129.5 |

FOREIGN PATENT DOCUMENTS

| | | | |
|---|---|---|---|
| 853491 | 10/1952 | Fed. Rep. of Germany | 242/130.1 |

*Primary Examiner*—Stanley N. Gilreath
*Attorney, Agent, or Firm*—Richard D. Slehofer

[57] ABSTRACT

An adjustable thread and yarn dispenser and winder caddy includes a base supporting a vertically mounted dowel over which is mounted a removable spindle. On the spindle is at least one thread supporting member frictionally fitted and vertically adjustable thereon. The bottom of the spindle rests loosely on the base and is freely rotatable. A spool of crochet thread or skein of yarn may be mounted between the vertically adjustable and removable frusto-conical support members which accommodate variances in spool sizes, shapes and thread mass. A hank of thread or left-over length of yarn may be wound onto the spindle for storage or for dispensing. Flat circular discs can be substituted for the frusto-conically shaped support members.

8 Claims, 14 Drawing Figures

YARN CADDY

This is a continuation-in-part of U.S. patent application Ser. No. 422,393, filed on Sept. 24, 1982, now abandoned.

BACKGROUND OF THE INVENTION

This invention relates to a *Yard Caddy* adaptable for use with tubular-shaped spools of crochet thread, cone-shaped spools of thread, skeins of yarn, and with hanks of thread.

For many years crochet thread has been available on tubular shaped spools and on cone-shaped spools and, unless secured in some manner, such spools tend to tip over and roll about, becoming tangled and soiled. Problems also exist with skeins of yarn, which have no center support or spool on which it is wound, it being necessary to either hand-wind the skein into a ball, which ball tends to roll about, getting tangled and soiled, or having to pull the yarn a few feet at a time as it is used, from the center of the skein which is tiring and time consuming.

Many forms of restraint have been tried in an effort to control the thread, whose most commonly used being brown paper bags, bowls, large coke bottles, and gallon-size plastic bleach bottles, any one of which is unsightly, unhandy, and a source of embarrassment to the user.

Thread dispensers have been invented which will restrain spools of crochet thread but most are designed to handle only the tubular spool and cannot be adapted to use with the cone-type spool or with skeins of yarn. U.S. Pat. No. 4,112,711, issued to Luther W. Tripp, Sept. 12, 1978, is designed specifically to dispense yarn from skeins, but it will not adapt to spools to crochet thread of either the tubular or cone-shaped type spool.

There is also an invention onto which skeins of yarn and hanks of thread may be wound and dispensed, referring specifically to U.S. Pat. No. 3,637,150, issued Jan. 25, 1972, to Darrell G. Butz, but because of its physical structure, it is limited to yarn and hank-type thread.

Most existing dispensers have a complicated rotational system involving the use of ball or roller bearings in the base, making them expensive to manufacture and because of the added weight, expensive to ship.

SUMMARY OF THE INVENTION

The principle object of my invention is to provide an adjustable thread and yarn dispenser and winder which is adaptable for use with thread on spools of multiple forms and multiple sizes, more particularly, from tubular-shaped spools, cone-shaped spools and from skeins of yarn, eliminating the need for a separate dispenser for each, and on which hanks of thread and less than full skeins of yarn may be wound.

The thread and yarn dispenser includes a dowel over which a spindle is vertically positioned and a pair of opposed slideable support members on the spindle which vertically adjust to the various forms and sizes of spools and to skeins of yarn.

Another object is to provide an adjustable thread dispenser and winder which will confine thread so it cannot roll about getting tangled and soiled, yet will not restrict the free flow of thread from a mass of thread mounted thereon, thereby eliminating the need to use a brown paper bag, a bowl, a coke bottle, or a gallon-size plastic bleach bottle to control the thread.

Another object of my invention is to provide a thread and yard dispenser which will eliminate the need to hand-roll skeins of yarn and hanks of thread into balls and eliminate the need to pull yarn on the center of a skein of yarn as it is used.

Another object of my invention is to provide a thread and yarn dispenser with a spindle assembly from which the support members are interchangeable, giving firm support to full or partially used skeins or to spools, of various shapes and size eliminating the top support member if not needed, and the spindle may be returned to the dowel of the caddy with minimal handling of the yarn and without disturbing the center mass of same. This substitution of discs for frusto-conical members also reduces the cost of manufacture of that with this process, only one set of each is needed for the spindle assembly.

A further object of my invention is to provide a dispenser and winder wherein, through the use of vertically adjustable frusto-conical members, which, because they will fit snugly into the holes found at both ends of tubular-type spools of thread, prevent the thread from slipping off the criss-cross winding found at either end of the spools and prevents possible binding on the tubing of the spindle.

Another object of my invention is to provide a secure, wobble-free mounting for a cone-shaped spool of thread.

A further object of my invention is to provide an adjustable dispenser and winder which offers multiple services from a minimum number of parts, which parts can be made of wood, plastic, metal or other suitable materials and which can be completely assembled or disassembled without the need to use hand tools, is compact, lightweight, inexpensive to manufacture and all of which parts are removable for storage and for portability.

Further objects and advantages of my invention will become apparent from consideration of the drawings and the ensuing description thereof.

DETAILED DESCRIPTION OF THE PREFERRED EMBODIMENTS

Figure 1:
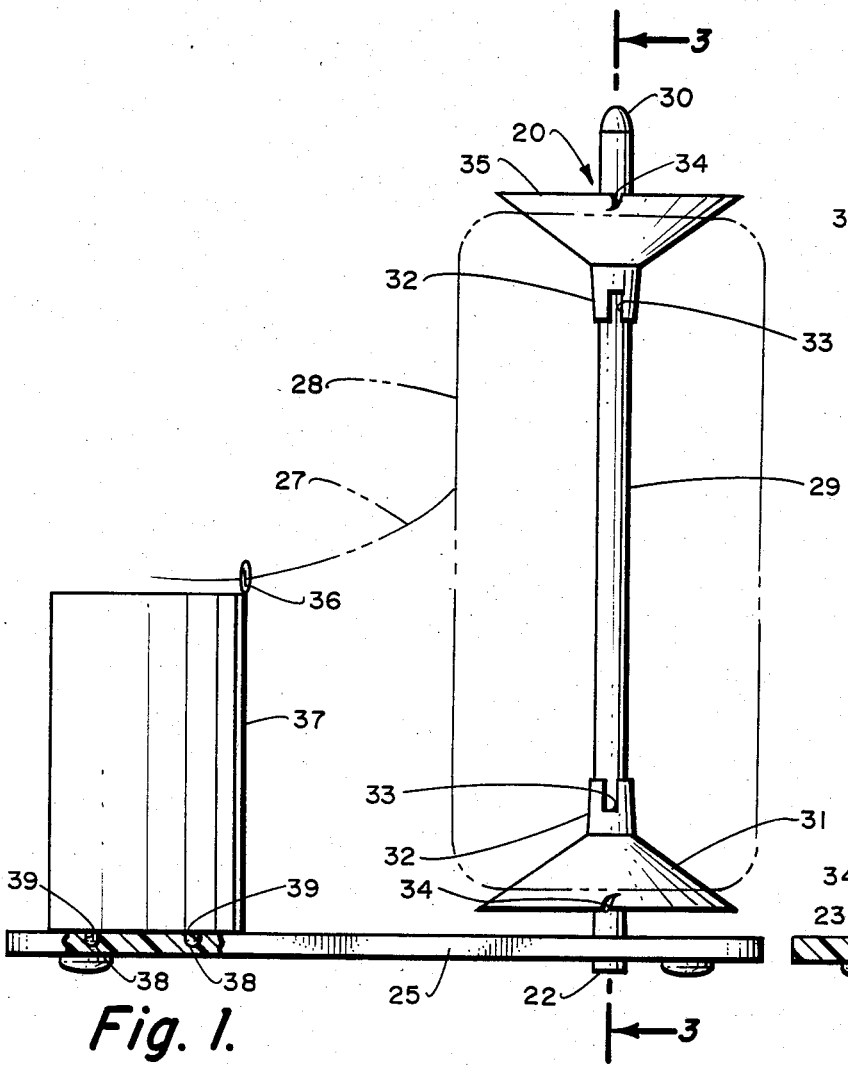
FIG. 1 is a front elevational view of a caddy, illustrating its use to dispense yarn from a skein.
Figure 3:
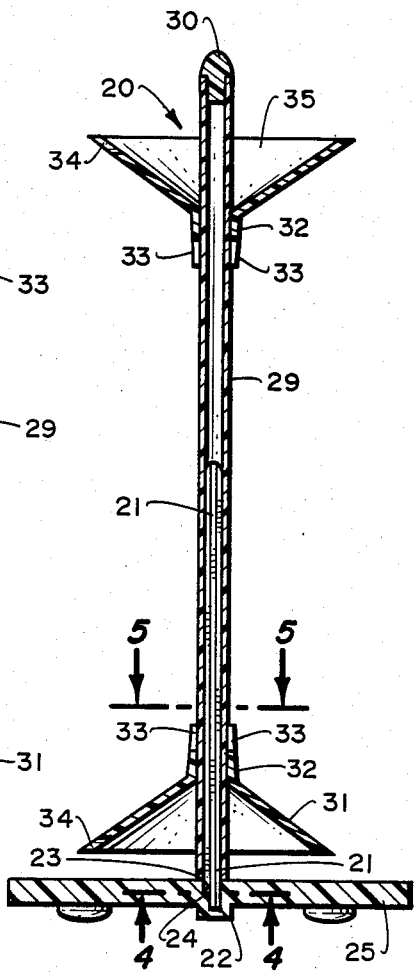
FIG. 3 is an elevational view taken along lines 3—3 of FIG. 1.
Figure 4:
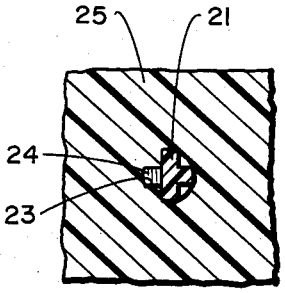
FIG. 4 is a cross-sectional view taken along lines 4—4 of FIG. 3.
Figure 7:
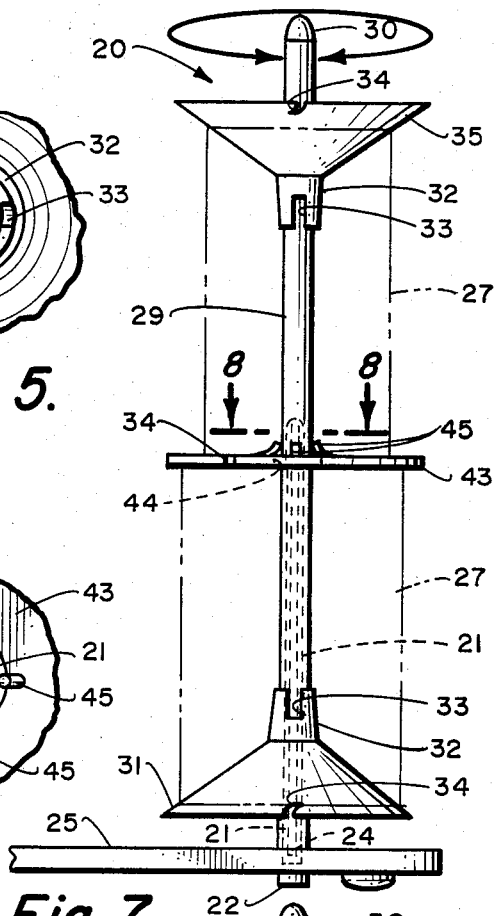
FIG. 7 is another alternative elevational view of the spindle when used as a winder for multiple colors and varied lengths of yarn.
Figure 10:
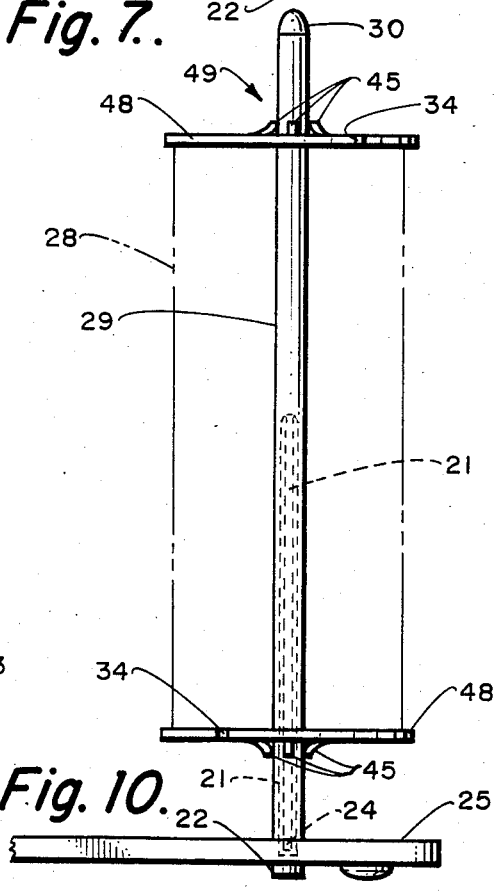
FIG. 10 is an alternate elevational view of the spindle with both frusto-conical members removed and replaced with discs, supporting a skein of yarn as seen in phantom lines.

Referring to the drawings, FIGS. 1 and 3 illustrate one embodiment of my invention. FIGS. 7 and 10 illustrate another embodiment, showing the application of the invention. In FIG. 1 can be seen a skein of yarn 28, shown in phantom lines axially mounted between a bottom member 31 and a top member 35 on a spindle 20; the spindle 20 fitting sleeve-like and freely revolving around a cruciformed dowel 21. The dowel 21 as shown in more detail in FIG. 3, is vertically and demountably positioned in the base 25 by connection means comprising a lock tab socket 22 with key-hole cavity 23, which lock tab socket 22 is found near one end of the base 25. One section of the bottom end of the cruciformed dowel 21 configuration comprises a securement means by serving as a lock tab 24 fitting snugly and vertically into the cavity 23 of the lock tab 24, shown in FIG. 4. The bottom end of the spindle 20 rests loosely on the top surface of the base 25 on which it freely rotates as yarn 27 is pulled from the outside perimeter of the skein of yarn 28.

Figure 12:
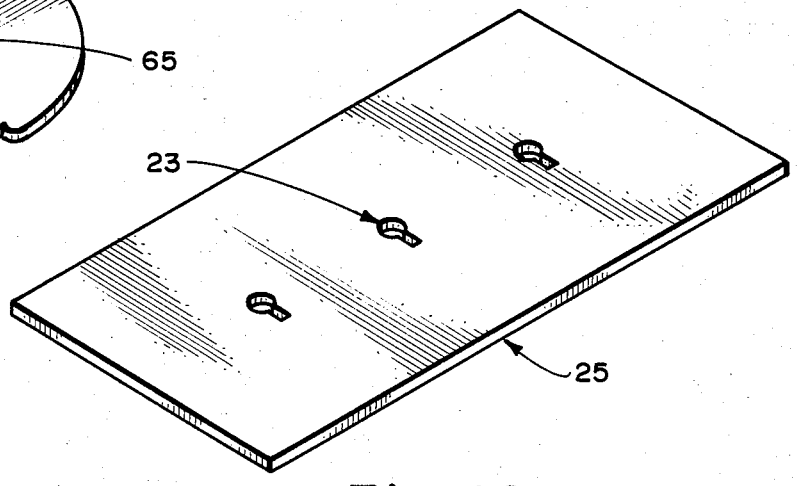
FIG. 12 illustrates a perspective view of the base.

FIG. 12 discloses a perspective view of the base 25 showing three key hole cavities 23.

The spindle 20 comprises a length of tubing 29. The hollow tubing 29 has a paraboloid-shaped plug 30 at its top end and open end bearing on the base. There is disclosed a support member 31. In the cylindrical projection 32, extending from the support member 31, there are two elongated, vertical slots 33, on each side of the projection 32, providing frictional engagement means for maintaining the member 31 at a predetermined position along the length of the tubing 29, as shown in more detail in FIGS. 1, 6, and 7. A thread keeper 34 is located at the outside rim of the bottom support member 31. A top frusto-conically shaped support member 35 can be seen with projection 32 in the down position encircling the tubing 29, which top member 35 and projection 32 are identical in configuration to the bottom member 31 and its projection 32, but are separate in function. Both members 31 and 35 with projections 32 are slidable on the tubing 29 and are removable therefrom. The members 31 and 35 are funnel shaped and each one has a frusto-conical surface.

Figure 2:
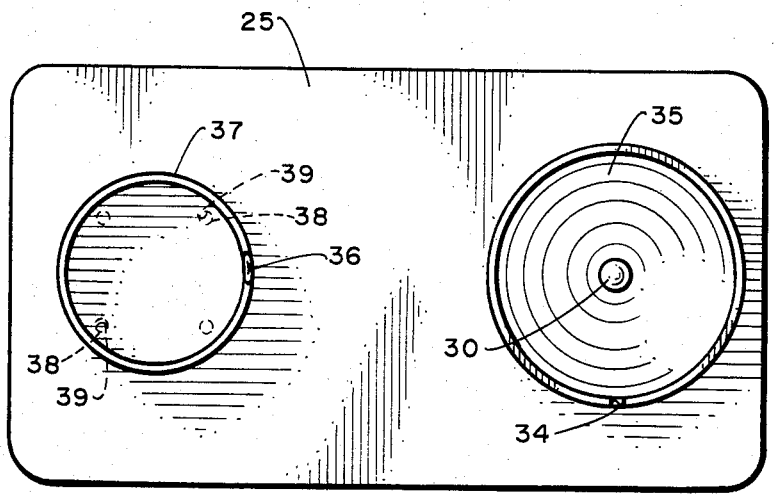
FIG. 2 is a top plan view showing the tool storage compartment's fastening arrangement and the spindle as viewed from above.

A thread guide 36, through which a length of yarn 27 extending from the skein of yarn 28 has been threaded, is located at the top edge of the tool storage compartment 37 nearest the spindle 20, which tool storage compartment 37 is located on the top surface near the opposite end of the base 25 from the spindle 20 where it is secured with multiple pins 39 projecting downwards from the bottom side of the tool storage compartment 37 to fit into multiple bores 38 in the base 25 designed to receive the pins 39, as is shown in FIGS. 1 and 2.

Figure 6:
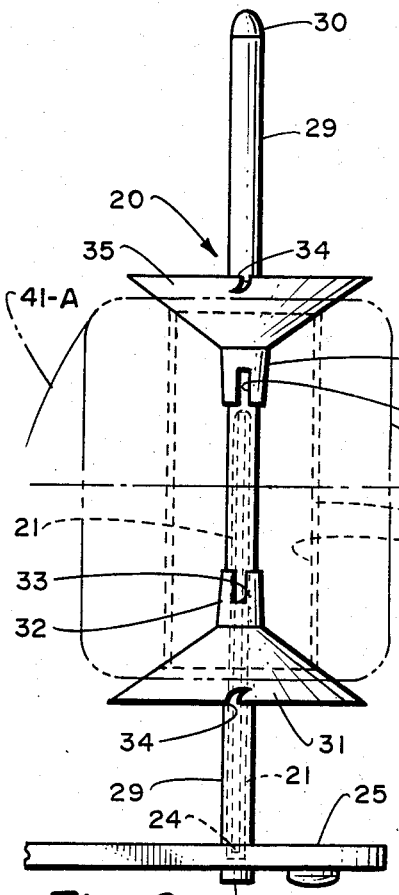
FIG. 6 is an alternate elevational view of the spindle as used for dispensing thread from a tubular shaped spool of crochet thread.
Figure 5:
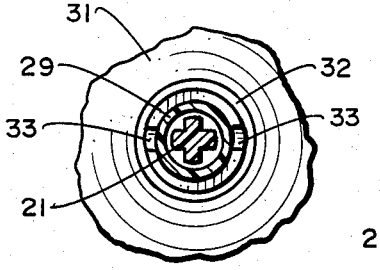
FIG. 5 is a cross-sectional view taken along lines 5—5 of FIG. 3.
Figure 8:
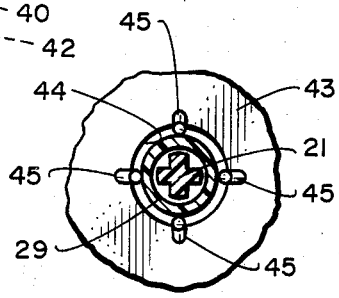
FIG. 8 is a cross-sectional plan view taken along lines 8—8 of FIG. 7.

FIG. 6 illustrates the mounting on the tubing 20 of a tubular-type spool 40 of crochet thread 41, also shown in phantom lines for clarity. The bottom member 31 has been adjusted upwards on the spindle 29 and the top member 35 has been lowered on the tubing 29 so both cylindrical projection 32 and a portion of both members 31 and 35 project into the inner cavity 42 of the tubular-type spool 40.

To illustrate the separation of colors of yarn 27 as may be wound onto the spindle 20, a round flat circular disc 43 can be seen in FIG. 7. The disc 43 has a center bore 44 therethrough from which multiple flexible tabs 45 project inwardly toward the center of the bore 44 providing frictional engagement of the disc around the tubing 29 and are adjustable vertically on the tubing 29 and are removable therefrom. The tubing 29 is resilient and compressible.

Figure 9:
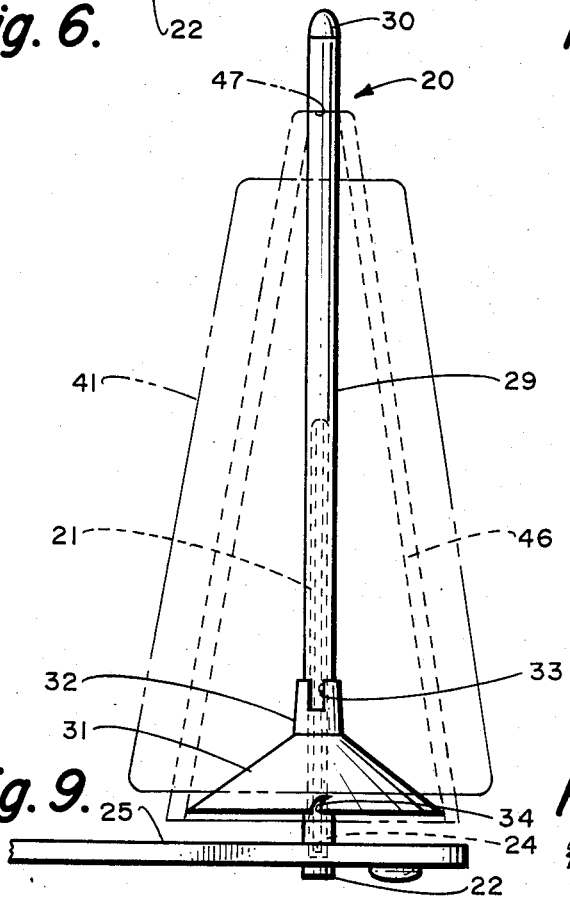
FIG. 9 is an alternate elevational view of the spindle with the top frusto-conical member removed, illustrating the use of the spindle to secure a cone-shaped spool of crochet thread.

A cone-shaped spool 46, shown in phantom lines for clarity, of crochet thread 41 can be seen as mounted in FIG. 9, the base of the cone-shaped spool 46 being supported on the top surface of the bottom member 31, the top member 35 having been removed from the tubing 29. The top end of the spindle 20 with plug-type tip 30 can be seen protruding vertically through the hole 47 in the top of the cone-shaped spool 46. If no hole 47 at the top of the spool 46 exists, as sometimes is the case, the top-most point of the cone-shaped spool 46 will rest on the plug-type tip end 30 of the tubing 29 and the bottom frusto-conical member 31 is moved up on the tubing 29 until the necessary support point is reached.

Figure 11:
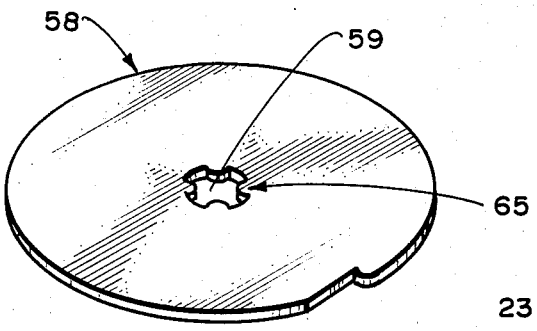
FIG. 11 illustrates a perspective view of the disc illustrating the rigid stop tabs extending into the center hole.
Figure 13:
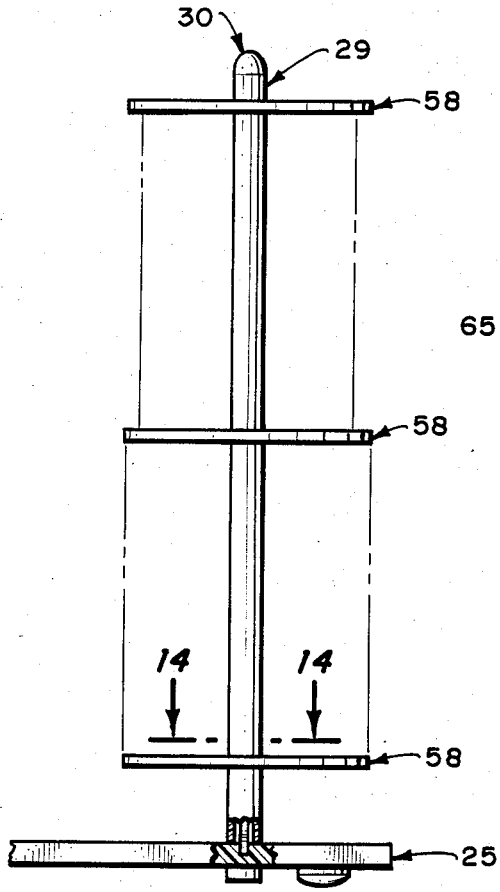
FIG. 13, which is similar to FIG. 10, illustrates an alternative embodiment of the invention having rigid stop tabs not visible from this view.
Figure 14:
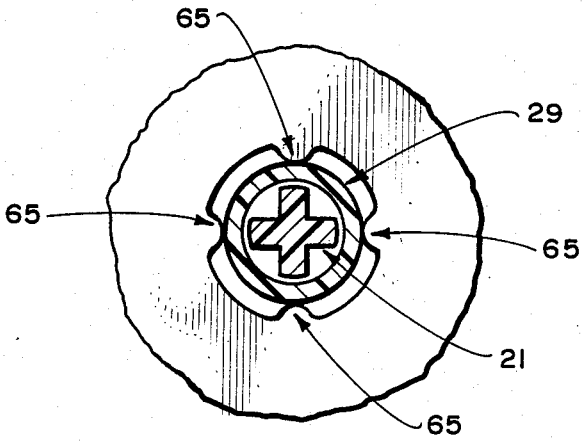
FIG. 14 is a cross-sectional view taken along the lines 14—14 of FIG. 13 showing an alternative embodiment of the disc with rigid stop tabs.

In FIG. 10 both support members 31 and 35 have been removed from the spindle 20 and replaced with support members illustrated as discs 48. The top disc 48 is needed when winding yarn onto the spindle 20 from a skein 28 or hank of thread, but may be omitted if a full skein is installed on the spindle 20. FIGS. 11, 13 and 14 illustrate an alternative embodiment of the invention wherein there is disclosed at least one circular disc having at least one rigid radial projection. The radial projections 65 are to allow for tolerances between the tubing 29 and the center bore 59. In the manufacturing process, occasionally the tubing cut to form the spindle 20 has a varying diameter. Accordingly, the center bore 59 with the radial projections 65 is large enough so that it can slide axially up and down around the circumference of the tubing 29, but may be stationed or positioned where desired and the projections 65 will compress or pinch in on the outside diameter, or circumference of the tubing 29 sufficiently to maintain the disc 58 in a horizontal plane relative to the upright perpendicular spindle 20.

FIG. 11 is a perspective of the flat circular disc 58 having at least one rigid radial projection 65. In this embodiment there are disclosed four rigid radial projections. FIG. 14 is an enlarged fragmentary view showing the relationship between these rigid projections 65 and the tubing 29. FIGS. 14 and 11 shown enlarged exaggerated views of these projections 65. In actual use the projections are several and very small, but are large enough to pinch-in the resilient compressible tubing 29 thereby holding the circular disc 58 in the position it was adjusted to.

FIG. 13 is an elevational view showing these rigid circular discs 58 in spacial relationship on the spindle 20. The phantom lines indicate that there are two tiers of threading or yarn 27, one at the lower tier and one at the upper tier. The circular disc 58 can be vertically adjusted by rocking and pushing down or up to adjust the vertical position of each one of these discs 58. The vertical adjustment is to allow for the various lengths of yarn used in these embodiments.

OPERATION

To use the adjustable thread and yarn dispenser with a skein of yarn the spindle 20 is removed from the dowel 21 and the top support member 35 is then removed from the spindle 20. The tubing 29, tip end 30 first, is then inserted in the center bottom end of the skein 28 and is pushed vertically up and through the center axis of the skein 28 and the bottom of the skein 28 rests on the top surface of the bottom support member 31. If needed, the top member 35 is then returned to its place on the spindle 20 where it secures the yarn 28 at the top end. It is optional with the user that the yarn 27 be threaded through the thread guide 36 attached to the tool storage compartment 37. In this operation, discs 48 may be used in place of the frusto-conical members 31 and 35.

To mount a spool of crochet thread 41 as seen in phantom lines in FIG. 6, the same mounting process as above described is followed, with the exception that the spool of crochet thread 41 is adjusted vertically on the spindle 20 between the two frusto-conical members 31 and 35. As the thread mass 41 is reduced in use, the top frusto-conical support member 35 is moved lower on the tubing 29 to maintain its snug fit inside the spool of crochet thread 41.

When the spindle 20 is to be used to mount two colors or lengths of yarn 27 as is illustrated in FIG. 7, the top member 35 is removed from the spindle 20 and the end of the first yarn 27 to be wound is secured in the thread keeper 34 of the bottom member 31. Another support member, illustrated as a disc 43 is mounted on the tubing 29 at a point determined to provide sufficient room between the disc 43 and the bottom member 31 to contain the amount of yarn 27 needed, which is then wound on by grasping the top end of the tubing 29 between the thumb and forefinger of one hand and rotating the spindle 20 until the desired amount of yarn 27 is in place. At the same time and with the other hand, the use directs the flow of yarn 27 to ensure even layering as the yarn 27 builds up on the spindle 20. The same winding process is repeated for the second color of yarn 27, but securing it in the thread keeper of the top frusto-conical member 35. This same type winding process may be used to wind a hank of thread onto the spindle, eliminating the use of the disc 43 if not needed. Discs 48 or 43 may be substituted for cone members 31 and 35.

A cone-shaped spool 46 of crochet thread 41 is mounted on the spindle 20 after first removing the top member 35 as is shown in FIG. 9, then dropping the spool 46 down over the tubing 29 until the bottom of the cone 46 rests on the top surface of the bottom member 31 and the top of the tubing 29 extends vertically through the hole 47 at the top of the cone-shaped spool 46. Some cones 46 may not have a hole 47 at their top, in which case the inside, closed top end of the spool 46 will rest on the plug-type tip 30 of the tubing 29 and the bottom member 31 is then moved up on the tubing 29 to a point inside the spool 46 where support is established.

The spindle 20 may be converted to a storage spindle 49 for long-term storage of a skein of yarn 28 by replacing the bottom member 31 and the top member 35 with two storage discs 48 as is shown in FIG. 10. Two partially used skeins 28 may be similarly stored by lowering the top disc 48, compressing the skein 28 on the spindle 20 then adding the additional skein 28 with a third disc 48 added at the top. This process keeps both members 31 and 35 free for immediate use and the stored skeins 28 free of tangles.

For the functional operation of the spindle in all the mountings above mentioned, it is important that the bottom members 31 or 48 always be so positioned on the spindle 20 as to ensure that there will be clearance between the top surface of the base 25 and the bottom members 31 or 48 and anything mounted thereon. Use of the thread guide 36 is optional for all mountings.

While the above description contains many embodiments of the invention these should not be construed as limitations on the scope of my invention, but rather an exemplification of the preferred embodiment thereof. Other variations are possible. Another embodiment of my invention might include using the rotational mechanism of a record player whereby the spindle with support members in place on the spindle could be sleevelike and adjustably positioned around the center post of the turntable, securing the bottom support member to the turntable with adhesive-type tape. The thread to be wound would then be inserted in the thread keeper of the support member and the player turned on to preferably, 33 RPM, causing the thread to wind around the spindle and leaving both hands free to direct layering of the thread around the spindle.

Another embodiment of my invention might include frictionally fitting both members 31 and 35 on the tubing 29 with the use of multiple small friction tabs at the cylindrical projections instead of the slots 33 illustrated in the present invention.

Accordingly, the scope of the invention should be determined not by the embodiments illustrated or above described, but by the appended claims and their legal equivalents.

What is claimed is:

1. A yarn caddy comprising:

a base;

an upright spindle supporting dowel;

means on said base for vertically securing said dowel to said base and for preventing said dowel from rotating;

an upright spindle including a length of tubing rotatably supported by said dowel and having an end resting loosely on said base;

at least one removeable and vertically adjustable bottom support member means positioned on said tubing for vertically supporting a yarn or thread package on said spindle;

said bottom support member means comprising a generally frusto-conical surface having an axial cylindrical projection extending from the smaller end of said support member;

means for slideably and vertically adjusting the position of said support member means on said tubing;

said means for slideably and vertically adjusting the position of said support member means on said tubing comprising at least one expandable slot means on said axial cylindrical projection for allowing radial expansion of said cylindrical projection.

2. The yarn caddy as recited in claim 1 further comprising a removable top support member identical to said bottom support member, each said smaller end of each said support member being in opposed position to each other and each being vertically adjustable on said tubing for mounting a yarn or thread package.

3. The yarn caddy as recited in claim 2 further comprising a flat circular disc member having a centerbore and positioned intermediate each said top and bottom members on said spindle.

4. The yarn caddy as recited in claim 1 further comprising a paraboloid-shaped plug means inserted in one end of said tubing for preventing snagging of the yarn or thread package mounted thereon.

5. A yarn caddy comprising:

a base;

an upright spindle supporting dowel;

means on said base for vertically securing said dowel to said base and preventing said dowel from rotating;

an upright spindle including a length of tubing rotatably supported by said dowel and having an end resting loosely on said base;

at least one removable bottom support member means positioned on said tubing for vertically supporting a yarn or thread package on said spindle;

said bottom support member means comprising a flat circular disc member having a center bore slightly larger than the circumference of said tubing;

means for slideably and vertically adjusting the position of said circular disc member on said tubing;

said means for slideably and vertically adjusting the position of said circular disc member on said tubing comprising at least one rigid radial projection means extending radially from the edge of said center bore for frictionally engaging said tubing and maintaining said disc in a generally horizontal plane relative to said upright perpendicular spindle.

6. The yarn caddy as recited in claim 5 further comprising plug means inserted in one end of said tubing for preventing snagging of the yarn or thread package mounted thereon.

7. A yarn caddy comprising:

a base;

an upright spindle supporting dowel;

means on said base for vertically securing said dowel to said base and preventing said dowel from rotating;

an upright spindle including a length of tubing rotatably supported by said dowel and having an end resting loosely on said base;

at least one removable bottom support member means positioned on said tubing for vertically supporting a yarn or thread package on said spindle;

said bottom support member means comprising a flat circular disc member having a center bore slightly larger than the circumference of said tubing;

means for slideably and vertically adjusting the position of said disc member on said tubing;

said means for slideably and vertically adjusting the position of said disc member means on said tubing comprising at least one flexible tab means radially extending from the edge of said centerbore for frictionally engaging said tubing and maintaining said disc in a generally horizontal plane relative to said upright perpendicular spindle.

8. The yarn caddy as recited in claim 7 further comprising plug means inserted in one end of said tubing for preventing snagging of the yarn or thread package mounted thereon.

* * * * *